US006487941B1

(12) United States Patent
Ping

(10) Patent No.: US 6,487,941 B1
(45) Date of Patent: Dec. 3, 2002

(54) HAND TOOL

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/967,680

(22) Filed: Oct. 1, 2001

(51) Int. Cl.[7] ..... B25B 7/00
(52) U.S. Cl. ..... 81/300; 81/318; 7/128
(58) Field of Search ..... 81/300, 318; 7/125, 7/127, 128

(56) References Cited

U.S. PATENT DOCUMENTS

| | | | |
|---|---|---|---|
| 154,750 | A | 9/1874 | Flack |
| 164,750 | A | 6/1875 | Meyer |
| 237,138 | A | 2/1881 | Slayton |
| 266,073 | A | 1/1882 | Augetin |
| 295,885 | A | 3/1884 | Pullman |
| 310,439 | A | 1/1885 | Kamak |
| 337,858 | A | 3/1886 | Neuhaus |
| 358,312 | A | 2/1887 | Weck |
| 445,509 | A | 1/1891 | Thayer |
| 464,405 | A | 12/1891 | Widman |
| 542,601 | A | 7/1895 | Baker |
| 580,235 | A | 4/1897 | Strum |
| 589,392 | A | 7/1897 | Kelar |
| 592,766 | A | 11/1897 | Effinger et al. |
| 596,096 | A | 12/1897 | Watts |
| 614,537 | A | 11/1898 | Dahlquist |
| 649,334 | A | 5/1900 | Meloos |
| 662,005 | A | 11/1900 | Lewis |
| 696,995 | A | 4/1902 | Moser |
| 762,725 | A | 6/1904 | Kaufmann |
| 790,432 | A | 5/1905 | Heilrath |
| 857,459 | A | 6/1907 | Hendrickson |
| 858,003 | A | 6/1907 | Klever |
| 881,294 | A | 3/1908 | Billings |
| 896,746 | A | 8/1908 | McCarty |
| 948,231 | A | 2/1910 | Libby |
| 988,068 | A | 3/1911 | Beardsley et al. |
| 1,174,132 | A | 3/1916 | Dragun |
| 1,184,746 | A | 5/1916 | Hanson |
| 1,187,842 | A | 6/1916 | Kaas |
| 1,194,296 | A | 8/1916 | Jones et al. |
| 1,334,425 | A | 3/1920 | Wernimont |
| 1,370,906 | A | 3/1921 | Newton |
| 1,461,270 | A | 7/1923 | Garrison |

(List continued on next page.)

FOREIGN PATENT DOCUMENTS

| | | |
|---|---|---|
| CH | 277412 | 8/1951 |
| DE | 29556 | 4/1884 |
| DE | 30788 | 8/1884 |
| DE | 145784 | 11/1903 |
| DE | 2322229 | 5/1974 |
| DE | 91 03 496.5 | 8/1991 |
| EP | 97100156 | 7/1997 |
| FR | 409943 | 5/1910 |
| FR | 2308470 | 12/1976 |
| GB | 5375 | of 1882 |
| GB | 21369 | of 1895 |
| GB | 17248 | of 1896 |
| GB | 20299 | of 1902 |
| GB | 15859 | of 1904 |
| GB | 13254 | of 1905 |
| GB | 14268 | of 1907 |
| GB | 186520 | 10/1922 |
| GB | 403769 | 1/1934 |
| IT | 521555 | 3/1955 |
| RU | 1002145 | 3/1983 |

*Primary Examiner*—James G. Smith
*Assistant Examiner*—Hadi Shakeri
(74) *Attorney, Agent, or Firm*—Joseph J. Previto

(57) ABSTRACT

A hand tool having a pair of jaw assemblies pivotally mounted to each other and movable from a closed to an open position. Each jaw assembly comprising a head portion and a tail extending from the head portion. A hang space formed between said jaw assemblies.

4 Claims, 8 Drawing Sheets

U.S. PATENT DOCUMENTS 1,467,661 A 9/1923 Undy
1,472,826 A 11/1923 Champlin
1,474,592 A 11/1923 Jacoby
1,486,725 A 3/1924 Brown
1,511,340 A 10/1924 Jackson
1,524,694 A 2/1925 Di Maio
1,551,328 A 8/1925 Perry
1,561,833 A 11/1925 Cruickshank
1,561,993 A 11/1925 Nielsen
1,578,157 A * 3/1926 Miller ..... 24/3.6
1,619,181 A 3/1927 Beretz
1,828,121 A 10/1931 Adam
2,057,201 A 10/1936 Mc Cluskey
D137,408 S 3/1944 Frisk
D149,934 S 6/1948 Cobb
2,514,130 A 7/1950 Jones
2,561,682 A 7/1951 Barnett
2,575,652 A 11/1951 Bovee
2,606,471 A 8/1952 Kollweck
2,641,149 A 6/1953 Petersen
2,714,249 A 8/1955 Clark et al.
2,747,446 A 5/1956 Eder
2,779,098 A 1/1957 Pocoski et al.
2,814,108 A 11/1957 Bascott
3,044,081 A 7/1962 Robinson, Jr.
3,364,508 A 1/1968 Garrett
3,398,746 A * 8/1968 Abramson ..... 606/147
3,798,687 A 3/1974 Stevens
3,858,258 A 1/1975 Stevens
3,947,905 A 4/1976 Neff
4,208,749 A 6/1980 Hermann et al.
4,226,105 A * 10/1980 Wehrman ..... 70/456 R
4,238,862 A 12/1980 Leatherman
4,297,756 A 11/1981 Lance
4,330,937 A 5/1982 Cope
4,347,665 A 9/1982 Glesser
4,364,174 A 12/1982 De Asis
4,502,220 A 3/1985 Aoki
4,512,051 A 4/1985 Magan
4,555,822 A 12/1985 Miseli
4,563,833 A 1/1986 Aucoin
D286,501 S 11/1986 Magan
4,648,145 A 3/1987 Miceli
4,669,140 A 6/1987 Miceli
4,744,272 A 5/1988 Leatherman
4,805,303 A 2/1989 Gibbs
4,888,869 A 12/1989 Leatherman
4,896,424 A 1/1990 Walker
4,942,637 A 7/1990 Yoang Yai
4,995,128 A 2/1991 Montgomery et al.
5,014,379 A 5/1991 Hull et al.
5,029,355 A 7/1991 Thai
5,044,079 A 9/1991 Gibbs
5,062,173 A 11/1991 Collins et al.
5,074,046 A 12/1991 Kolesky
5,119,520 A 6/1992 Finn
D327,826 S 7/1992 Neff
5,142,721 A 9/1992 Sessiona et al.
5,157,996 A 10/1992 Keyvani
5,207,012 A 5/1993 Lael
5,212,844 A 5/1993 Sessions et al.
D338,386 S 8/1993 Frazer
5,267,366 A 12/1993 Frazer
5,320,004 A 6/1994 Hsiao
D356,019 S 3/1995 Sakai
D365,266 S 12/1995 Hasegawa
5,491,856 A 2/1996 Legg
D367,807 S 3/1996 Hung
5,497,522 A 3/1996 Chen
D368,634 S 4/1996 Frazer
D371,498 S 7/1996 Lai
5,537,750 A 7/1996 Seber et al.
D382,182 S 8/1997 Seber et al.
D384,872 S 10/1997 Yeh
5,697,114 A 12/1997 McIntosh et al.
5,745,997 A 5/1998 Berg et al.
5,765,247 A 6/1998 Seber et al.
D407,286 S 3/1999 Seber et al.
D407,287 S 3/1999 Seber et al.
D407,616 S 4/1999 Seber
D410,833 S 6/1999 Hasegawa
5,964,131 A 10/1999 Seber et al.
5,996,451 A 12/1999 Seber et al.
6,006,385 A * 12/1999 Kershaw et al. ..... 7/129
6,023,805 A * 2/2000 Lin ..... 7/128
6,047,426 A 4/2000 McIntosh et al.
6,202,517 B1 * 3/2001 Dolan ..... 81/418

* cited by examiner

HAND TOOL

BACKGROUND

The present invention relates to a hand tool, such as a plier and, more particularly, to a hand tool which may be hung from a key ring or similar article.

Hand tools are often carried by people on their person. Since some hand tools may be cumbersome to carry, small hand tools have been developed which can be hung from a key ring or similar article. Many of these existing small hand tools are complicated to use and expensive to manufacture.

OBJECTS

The present invention overcomes these difficulties and has for one of its objects the provision of an improved hand tool which may be easily hung and removed from a key ring or similar article.

Another object of the present invention is the provision of an improved hand tool which has additional tools associated therewith.

Another object of the present invention is the provision of an improved hand tool which is simple and inexpensive to manufacture and use.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
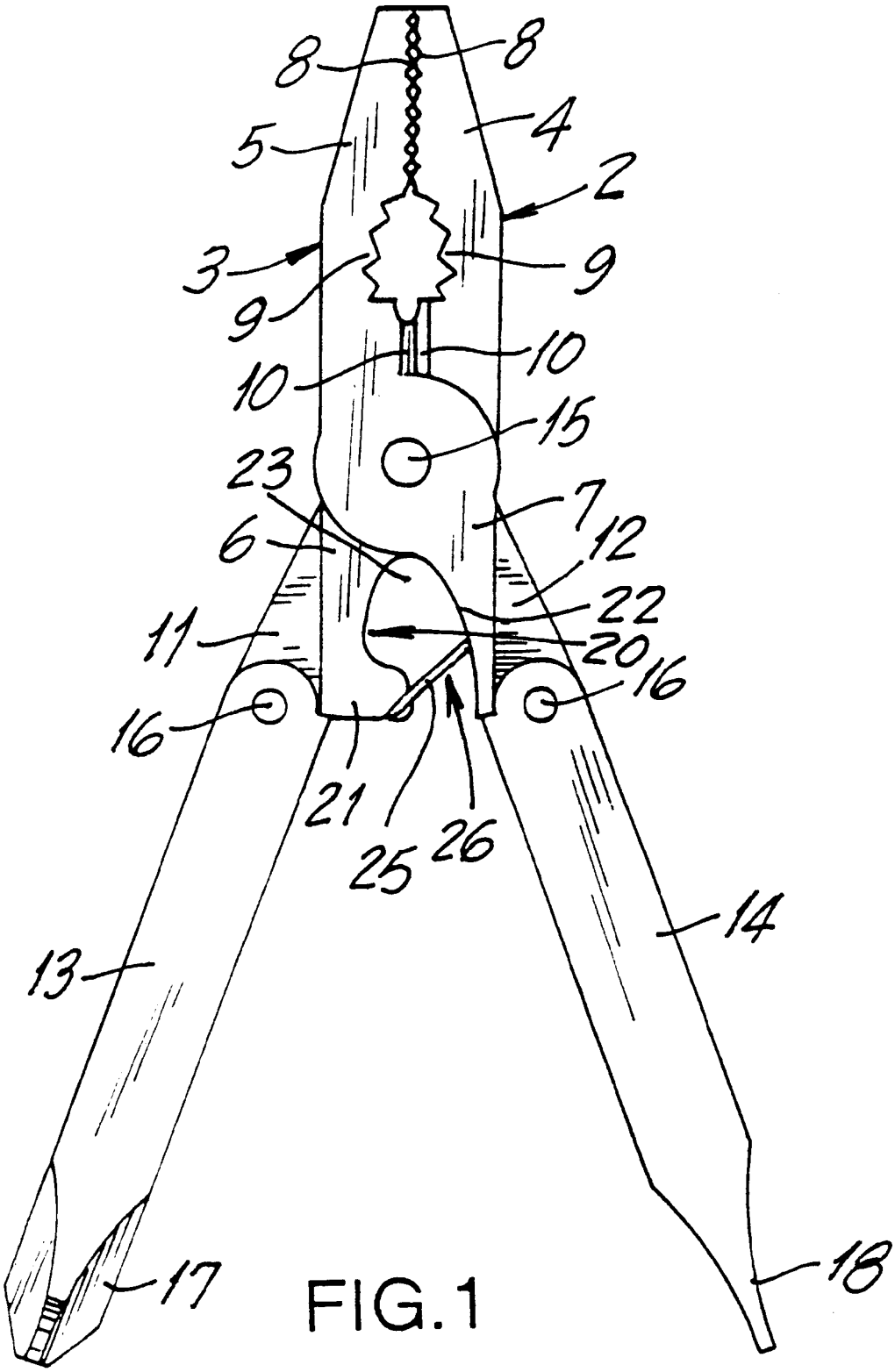
FIG. 1 is a plan view of a hand tool made in accordance with the present invention showing it in its unfolded position.
Figure 4:
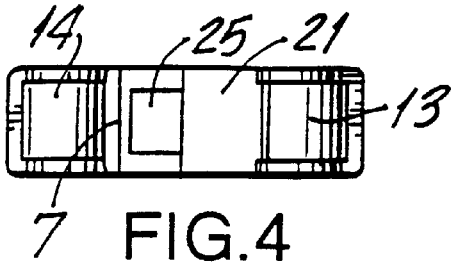
FIG. 4 is the rear view of the folded hand tool.
Figure 5:
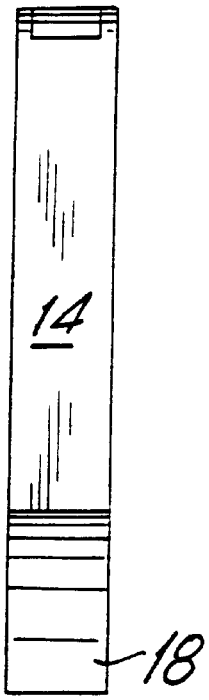
FIG. 5 is a side view of one side of the folded hand tool.
Figure 2:
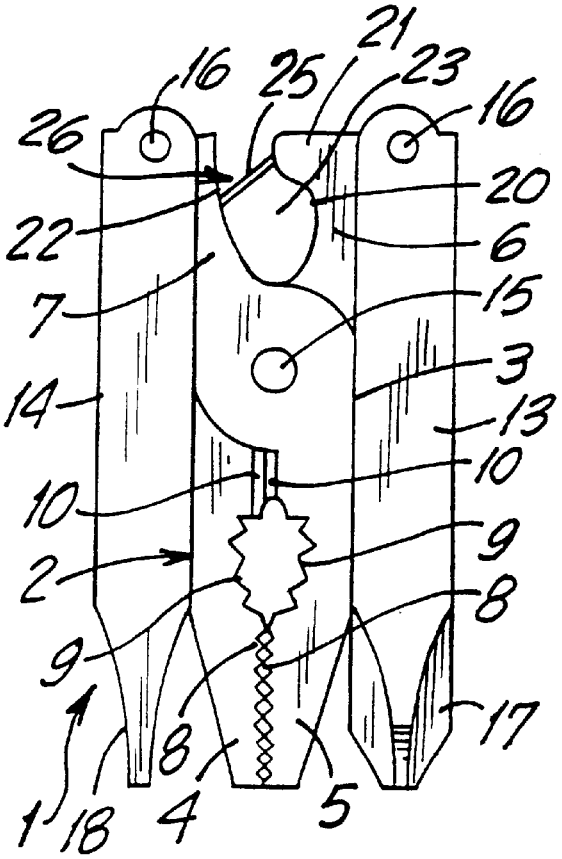
FIG. 2 is a plan view of the hand tool of FIG. 1 showing it in its folded position.
Figure 6:
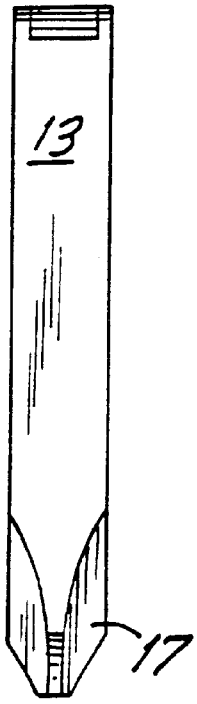
FIG. 6 is a side view of the other side view of the folded hand tool.
Figure 3:
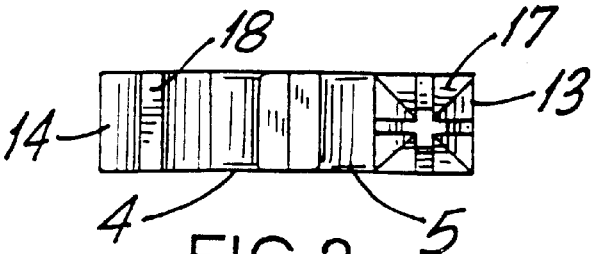
FIG. 3 is the front view of the folded hand tool.
Figure 7:
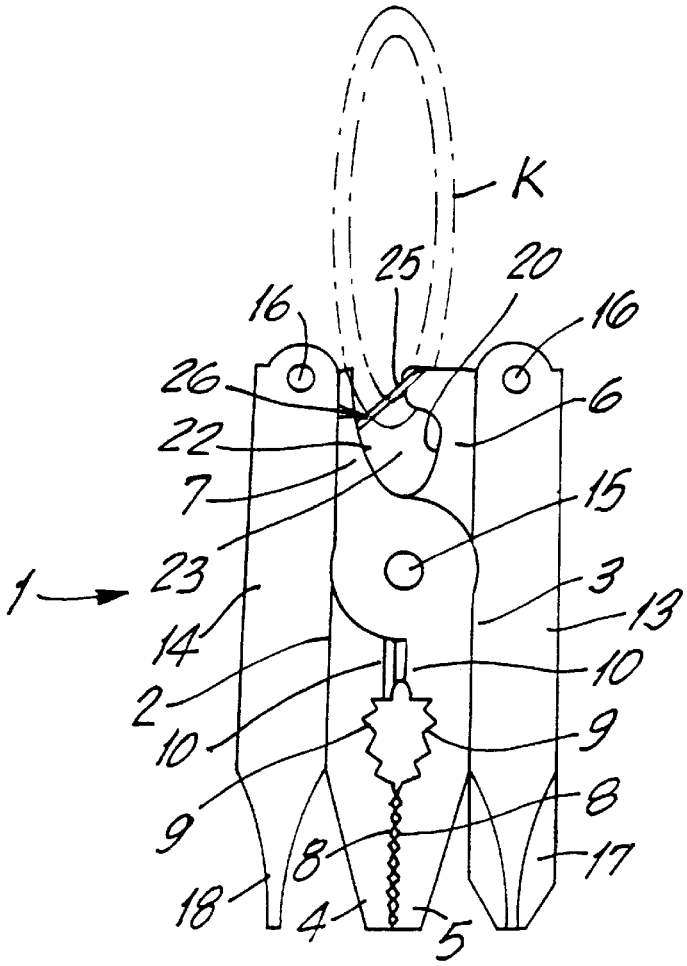
FIG. 7 is a plan view of the folded hand tool showing the manner in which the tool is hung from a key ring or similar article.
Figure 8:
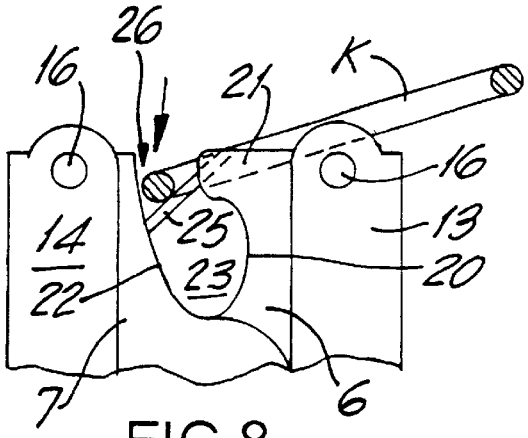
FIG. 8 is a plan view showing the hand tool being hung on a key ring or similar article.
Figure 9:
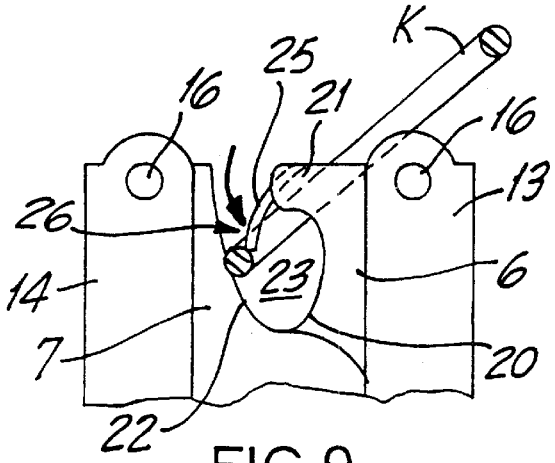
FIG. 9 is a plan view similar to FIG. 8 showing the hand tool hanging on a key ring or similar article.

Referring to the drawings and more particularly the embodiment of FIGS. 1–9, the hand tool 1 of the present invention comprises of a pair of jaw assemblies 2 and 3 which are pivotally mounted to each other on a pivot pin 15 to move from an open position to a closed position. Each jaw assembly 2 and 3 has a head portion 4 and 5, respectively, and a tail portion 6 and 7, respectively. Each head portion 4 and 5 has a straight teeth portion 8 and curved teeth portion 9, as well as a cutting edge 10. Each tail portion 6 and 7 has a lug 11 and 12, respectively, extending therefrom. Extending from the end of each lug 11 and 12 is a handle 13 and 14, respectively, each of which is pivotally mounted to the lugs 11 and 12 by a pivot pin 16. The tool may be placed in a folded position by folding the handles 13 and 14 around pivot 16 until the handles 13 and 14 lie adjacent the outer surfaces of the jaw assemblies 2 and 3, as shown in FIG. 2. Each handle 13–14 is preferably solid and square in cross section. The outer end 17 of one handle 13 may terminate in a Phillips screwdriver head and the outer end 18 of the other handle 14 may terminate in a slotted screwdriver head.

The tail 6 of the jaw assembly 2 has a curved notch 20 formed by a finger 21 extending inwardly from the tail 6. The tail 7 of the jaw assembly 3 has a curved inner surface 22 opposite to and spaced from the notch 20 in order to form a hang space 23 therebetween. The finger 21 terminates short of the surface 22 to form a gap 26 therebetween. The finger 21 of tail 6 has a resilient spring 25 extending therefrom which extends across the gap 26 and bears against the inner surface 22 of the tail 7. The spring 25 is preferably a leaf spring which is angled as shown in the drawings. As seen more clearly in FIGS. 7 and 8, when the hand tool 1 is in its folded position, a key ring K or similar article may be inserted in the hang space 23 by moving the key ring K past the gap 26 and the spring 25, which is flexed downwardly and which then snaps back to close the hang space 23 and hold the key ring K in place. When it is desired to remove the key ring K, it is moved against the spring 25 from the inside of the hang space 23 to lift the spring 25 in the opposite direction to move the key ring K out the hang space 23 and through the gap 26. If desired, the spring 25 may be manipulated manually to permit the key ring K to pass in and out of the hang space 23. Alternatively, the key ring K may be positioned in the hang space 23 when the jaw assemblies 2–3 are in their open position with the spring 25 spaced from the inner surface 22 so that when the jaws assemblies 2 are closed, the spring 25 strikes the inner surface 22 to close the hang space 23 and hold the key ring K in place.

Figure 11:
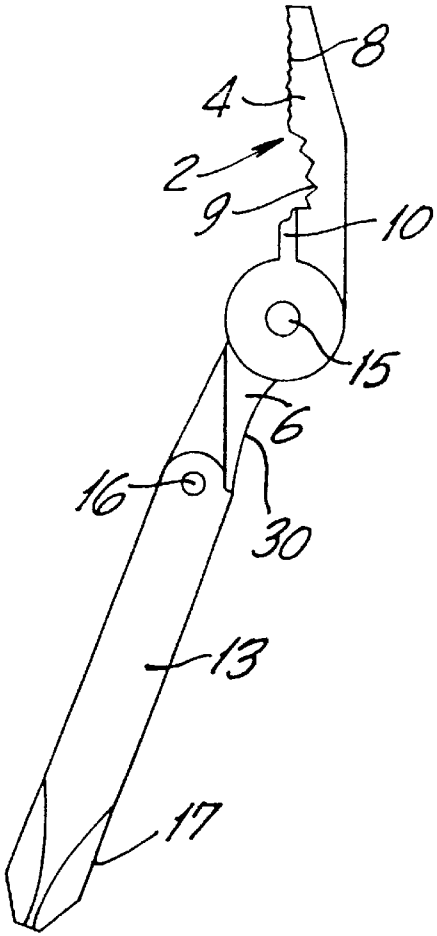
FIG. 11 is a plan view of a portion of the hand tool shown in FIG. 10.
Figure 10:
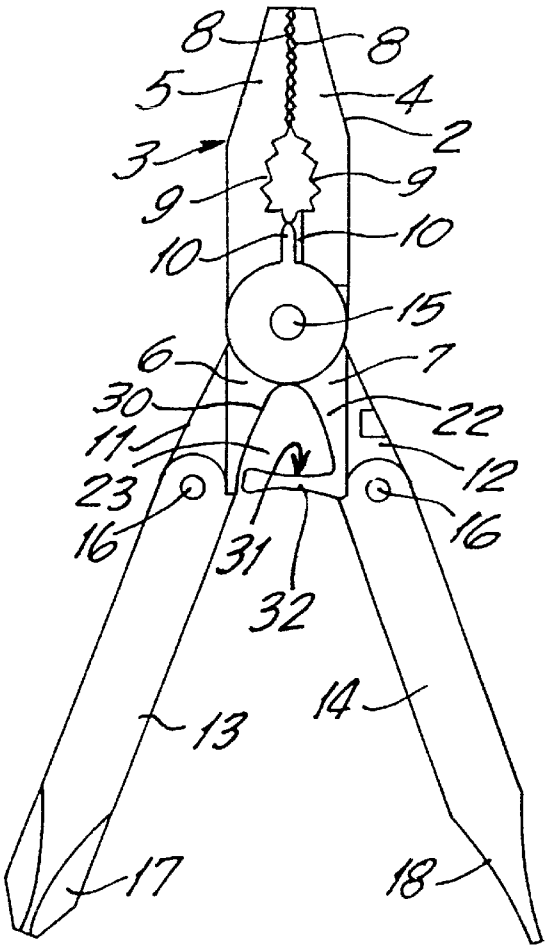
FIG. 10 is a plan view of another embodiment of the present invention showing a hand tool in its unfolded position.
Figure 12:
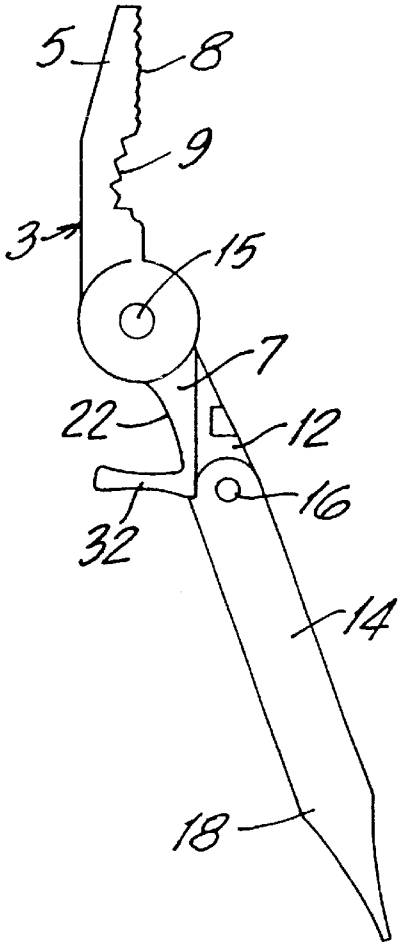
FIG. 12 is a plan view of another portion of the hand tool of FIG. 10.
Figure 13:
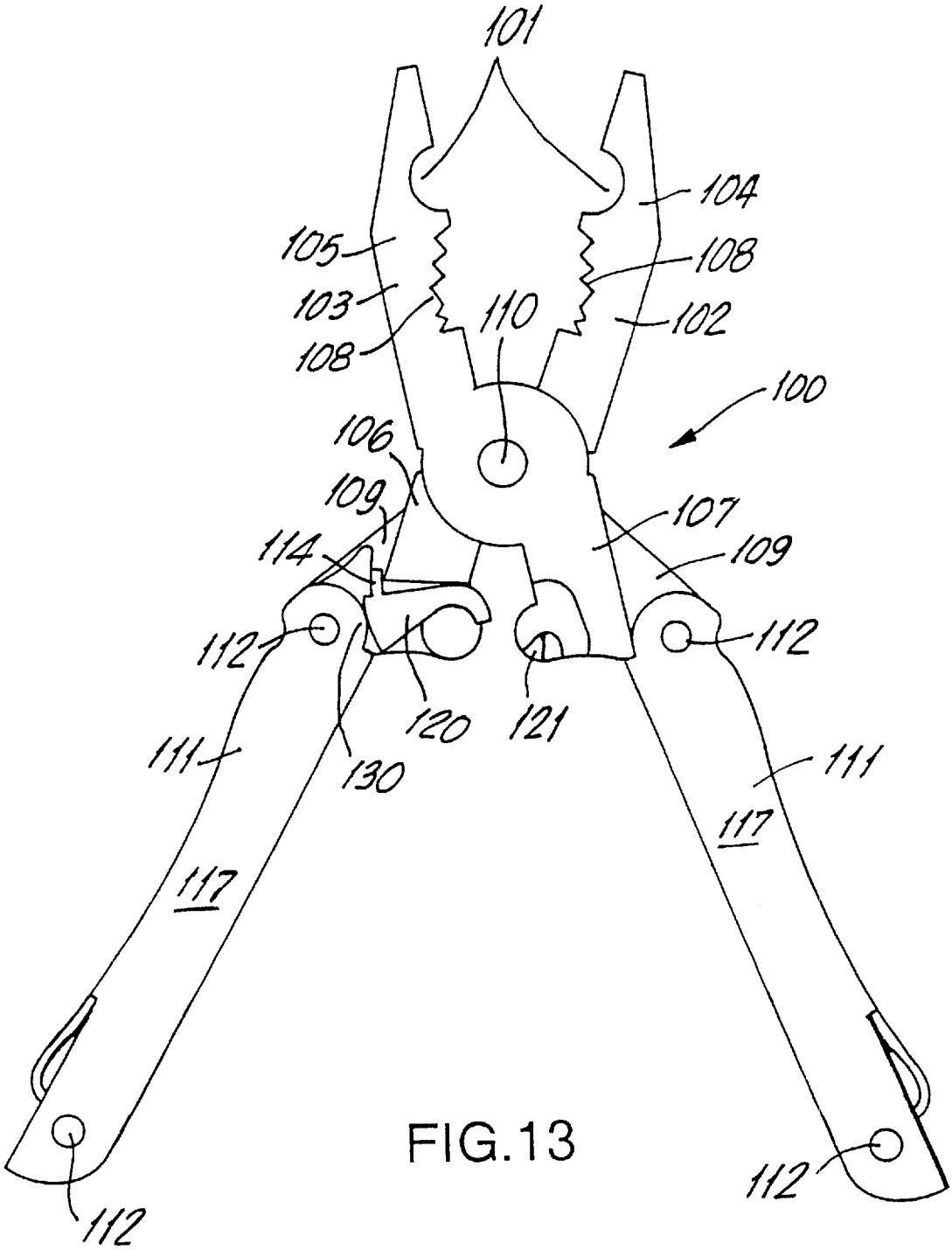
FIG. 13 is a plan view of still another embodiment of the present invention showing a hand tool in an unfolded position.

Referring now to the embodiment shown in FIGS. 10–12, the same reference characters that were used in the embodiment of FIGS. 1–9 will be used to identify the same structures. In this embodiment, the tail 6 has a curved inner surface 30 similar to and substantially complimentary to the curved inner surface 22 of the tail 7 to form a gap 31 between the surfaces 22 and 30. The tail 7 has a finger 32 extending across the gap 31. When the jaw assemblies 2–3 are closed, the finger 32 will strike the tail 6 thereby closing the gap 31 and hang space 23. A key ring K may be positioned in hang space 23 before the jaw assemblies 2–3 are closed so that after the jaw assemblies 2–3 are closed, the key ring K will be held in place in the hang space 23. When it is desired to remove the key ring K, the jaw assemblies 2–3 are opened thereby opening the hang space 23 in order to permit the key ring K to be removed from the hang space 23 through the gap 31.

Referring to the embodiment shown in FIGS. 13–17, the hand tool 100 has a pair of jaw assemblies 102 and 103 each having a head portion 104 and 105, respectively, and a tail portion 106 and 107, respectively, and being pivoted to each other by means of a pivot pin 110. A spring 115 is mounted around pivot pin 110 to keep the jaw assemblies 102–103 slightly separated when tool 100 is in its unfolded position. Each of the head portions 104 and 105 has curved teeth 108 and a semi-circular notch 101, the purpose of which will be described in greater detail hereinbelow.

Figure 14:
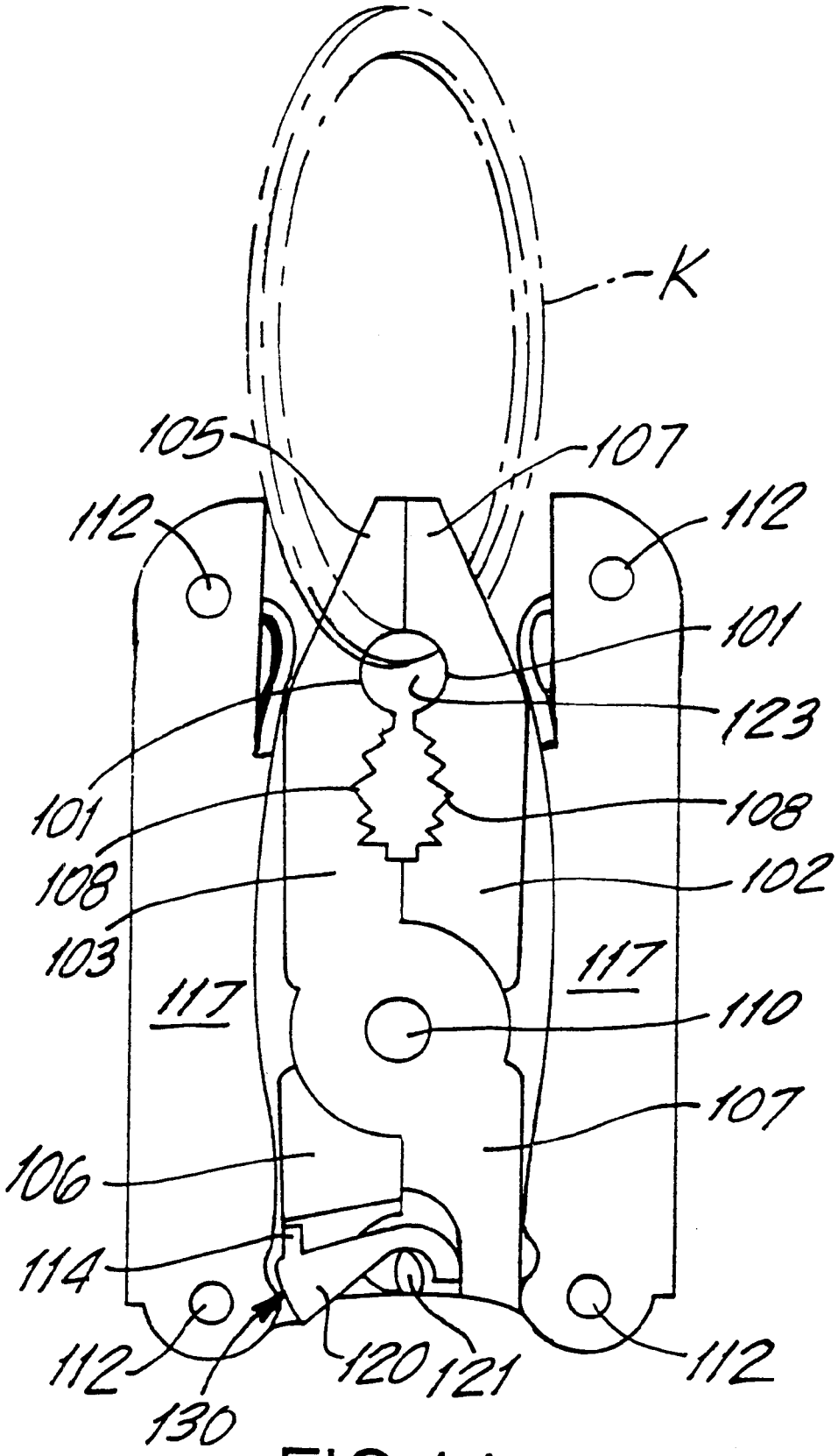
FIG. 14 is a plan view of the hand tool shown in FIG. 13 showing it in a folded position.
Figure 15:
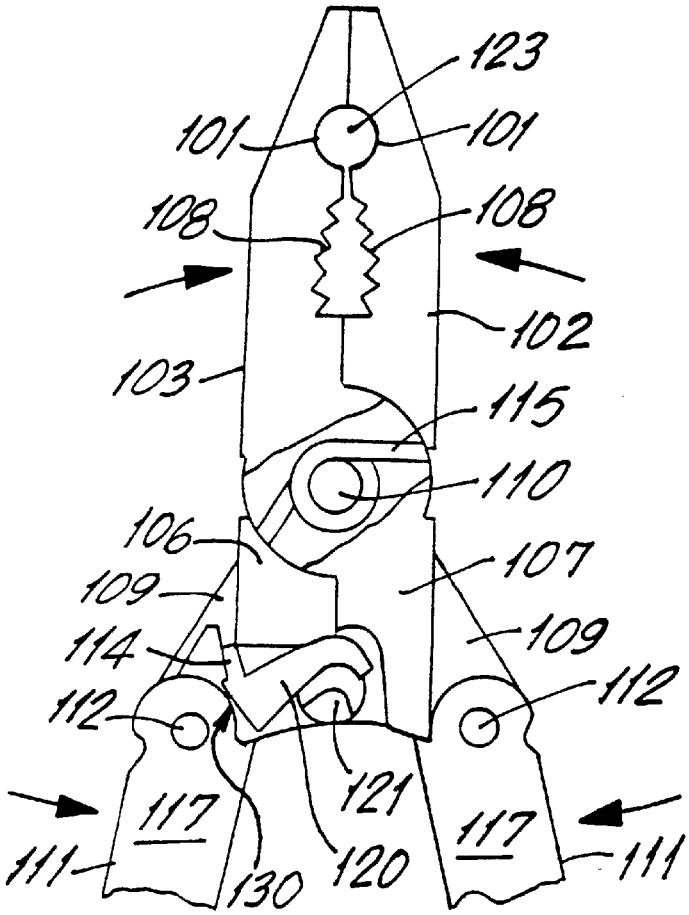
FIG. 15 is a plan view of the hand tool partly broken away showing the manner of unfolding the hand tool.
Figure 16:
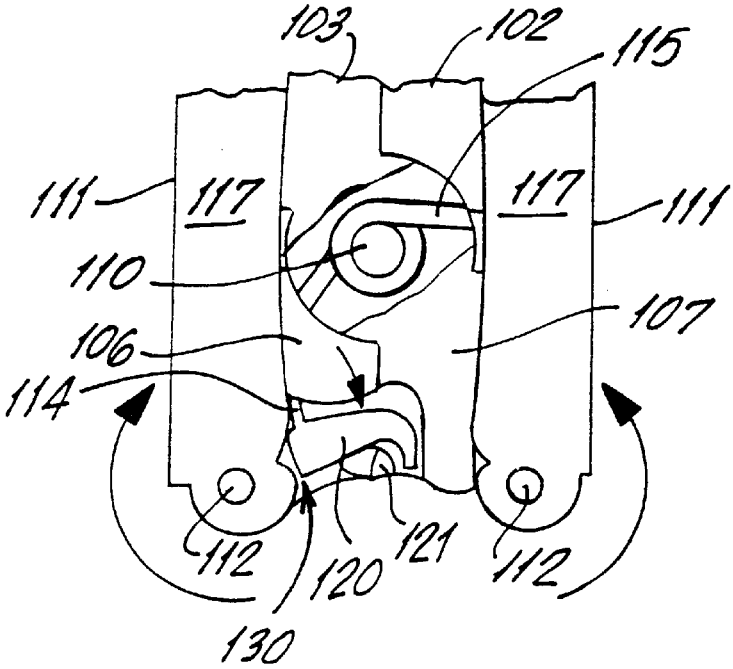
FIG. 16 is a plan view of the hand tool partly broken away showing the manner of folding the hand tool.
Figure 17:
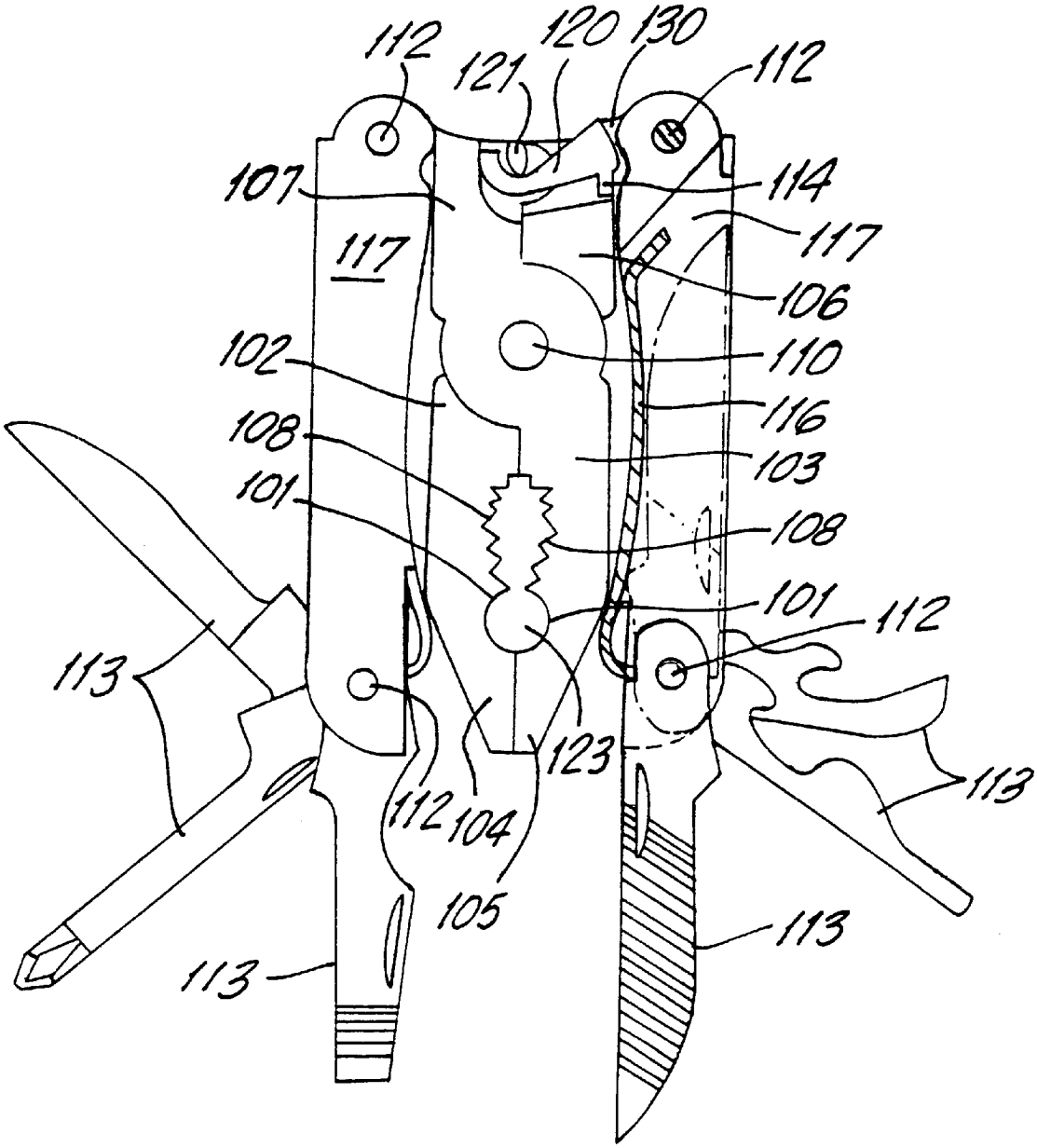
FIG. 17 is a plan view showing the folded hand tool with auxiliary tools in their extended positions.

Lugs 109 extend from each of the tail portions 106 and 107 and hollow handles 111 are pivotally mounted on the lugs 109 on pivot pins 112 adjacent to one end of the hollow handles 111. Each hollow handle 111 has a base 116, side walls 117 and is open opposite the base 116. The hollow handles 111 have a plurality of auxiliary tools 113 pivotally mounted thereon by means of a pivot 112 located at the outer end of the hollow handles 111 . The auxiliary tools 13 may consist of blades, drivers and the like. The auxiliary tools 113 are pivotally mounted within the hollow handle 111 and may be individually opened to permit them to be used, as shown in FIG. 17. When the jaw assemblies 102 and 103 are in the closed position, as shown in FIG. 14, the two semi-circular notches 101 for a key ring hang space 123 within which a key ring K may be held so that the hand tool 100 can hang from the key ring K.

In order to hold the two jaw assemblies 102–103 in the closed position, a hook 120 is provided on one tail 109 and a lock bar 121 is provided on the other tail 109. The hook 120 has a finger 114 extending rearwardly therefrom. When the jaw assemblies 102–103 are closed, the hook 120 is inserted over the lock bar 121 (FIGS. 11 and 13) to lock the jaw assemblies 102–103 together. The hook 120 is pivoted on the same pivot pin 112 on which the hollow handle 111 pivots so that when the hollow handle 111 is folded, as shown in FIG. 14, the edge 130 of the hollow handle 111 will move finger 114 up to place the hook 120 over the lock bar 121. When the handles 111 are unfolded, the hook 120 is lifted and moved off of the lock bar 121 so that the jaw assemblies 102–03 can now open.

It will thus be seen that the present invention provides an improved hand tool which may be easily hung and removed form a key ring or similar article, which has additional tools associated therewith and which is simple to manufacture and use.

As many and varied modifications of the subject matter of this invention will be apparent to those skilled in the art from the detailed description given herein above, it will be understood that the present invention is limited only as provided in the claims appended hereto.

The embodiments of the invention in which an exclusive property or privilege is claimed are defined as follows:

1. A hand tool comprising a pair of jaw assemblies pivotally mounted to each other and movable from a closed to an open position, each jaw assembly comprising a head portion and a tail extending from the head portion, a hang space formed in said head portion, said hang space is formed by semi-circular openings in each said head portions, lock means is provided to lock the jaw assemblies together, said lock means comprise a hook pivotally mounted on one of the tails and a lock bar mounted on the other tail and wherein said hook is adapted to be placed over said lock bar in order to keep the jaw assembly in a closed position, each of said tails has a lug extending therefrom said hook being positioned on one of said lugs and wherein a handle is pivotally mounted on each of said lugs, one of said handles adapted to contact said hook and move it over said lock bar.

2. A hand tool as set forth in claim 1 wherein said hook has a finger extending therefrom, and one of said handles contacts said finger and moves said hook over said lock bar.

3. A hand tool as set forth in claim 2, wherein auxiliary tools are pivotally mounted on said handles.

4. A hand tool as set forth in claim 3, wherein said handles are hollow and wherein said auxiliary tools are pivotally mounted within said hollow handles.

* * * * *